US008128090B2

(12) United States Patent
Paul

(10) Patent No.: US 8,128,090 B2
(45) Date of Patent: Mar. 6, 2012

(54) METHODS OF PLAY FOR BOARD GAMES

(76) Inventor: Curtis Paul, Potomac, MD (US)

( * ) Notice: Subject to any disclaimer, the term of this patent is extended or adjusted under 35 U.S.C. 154(b) by 0 days.

(21) Appl. No.: 12/683,290

(22) Filed: Jan. 6, 2010

(65) Prior Publication Data

US 2010/0171265 A1 Jul. 8, 2010

Related U.S. Application Data

(60) Provisional application No. 61/204,407, filed on Jan. 7, 2009, provisional application No. 61/235,288, filed on Aug. 19, 2009.

(51) Int. Cl.
*A63F 3/00* (2006.01)

(52) U.S. Cl. ..... 273/243; 273/262

(58) Field of Classification Search ..... 273/243, 273/255, 262, 265
See application file for complete search history.

(56) References Cited

U.S. PATENT DOCUMENTS

| | | | | |
|---|---|---|---|---|
| 628,773 | A | 7/1899 | Davis | |
| 972,382 | A | 10/1910 | Johnson-Jervis | |
| 1,245,096 | A | 10/1917 | Foster | |
| 1,666,953 | A | 4/1928 | Tuttle et al. | |
| 2,316,862 | A | 4/1943 | Haggard et al. | |
| 2,464,819 | A | 3/1949 | Lieberman | |
| 2,799,504 | A | 7/1957 | Keyko | |
| 3,831,944 | A | 8/1974 | Upton | |
| 3,860,241 | A | 1/1975 | Leftin | |
| 3,998,463 | A | 12/1976 | Zumchak | |
| 4,157,184 | A | 6/1979 | Recard, Jr. | |
| 4,373,731 | A * | 2/1983 | Whiteman et al. | 273/262 |
| 4,753,441 | A * | 6/1988 | Braus et al. | 273/255 |
| 4,982,965 | A | 1/1991 | Dozorsky | |
| 5,033,753 | A | 7/1991 | Yuen et al. | |
| 5,251,905 | A | 10/1993 | Bombino | |
| 5,570,887 | A | 11/1996 | Christie, Jr. | |
| 5,879,005 | A | 3/1999 | Baca | |
| 5,984,307 | A | 11/1999 | Fontana | |
| 6,062,562 | A | 5/2000 | Pardee | |
| 6,481,714 | B1 | 11/2002 | Jacobs | |
| 6,523,827 | B1 | 2/2003 | Watson | |
| 6,575,463 | B1 | 6/2003 | Wintersteen | |
| 7,294,058 | B1 * | 11/2007 | Slomiany et al. | 463/31 |
| 2004/0195768 | A1 * | 10/2004 | Poulos | 273/244 |

* cited by examiner

*Primary Examiner* — Vishu K. Mendiratta
(74) *Attorney, Agent, or Firm* — Sterne, Kessler, Goldstein & Fox PLLC

(57) ABSTRACT

Methods of play for board games are disclosed. In an embodiment, a method of play for a board game with a game board having a plurality of spaces includes the steps of: (a) providing a first player game piece having a strength value; (b) providing a first chance device capable of indicating chance values; (c) determining the movement of the first player game piece among the spaces of the game board; and (d) determining that the first player game piece located on a first space has defeated a second player game piece located on a second space adjacent to the first space, wherein the determinations in steps (c) and (d) are each based on both the strength value of the first player game piece and a chance value provided by the first chance device.

15 Claims, 6 Drawing Sheets

METHODS OF PLAY FOR BOARD GAMES

CROSS REFERENCE TO RELATED APPLICATIONS

This application claims priority to U.S. Provisional Patent App. No. 61/204,407, filed Jan. 7, 2009, and to U.S. Provisional Patent App. No. 61/235,288, filed Aug. 19, 2009, each of which are incorporated herein by reference in their entireties.

FIELD OF THE INVENTION

The present invention generally relates to board games. More particularly, the present invention relates to methods of play for board games.

BACKGROUND OF THE INVENTION

Games in which game pieces are moved about a premarked game board surface according to a particular set of rules are known in the art. Such board games may provide a form of entertainment to game players.

Many games involve elements of chance or strategy. Games of pure chance may not provide sufficient stimulation to their players, while games of pure strategy may discourage participation by relatively inexperienced players. Introducing elements of chance into a strategy game, however, may allow for more diverse and multi-faceted game strategies while also leveling the playing field between beginners and experts to some degree.

A problem with many traditional board games—particularly those involving significant strategy elements—is that they take too long to play. In our fast-paced modern society, many people are unwilling to devote hours on end to playing a board game.

An issue with board games that include a "physical" game board is that these games are not sufficiently portable—if the game board needs to be moved, game pieces may be scattered and their positions on the game board may be lost. This is a particular problem because most physical board games utilize game pieces that are not capable being securely, releasably coupled to the game board itself. Similarly, many physical game boards are so large relative to their game boxes that they must be folded or disassembled to be stored in the box. If the folding or disassembly requires that game pieces positioned on the board be removed, an interrupted game cannot be stopped, stored, and saved for resumption of play at a later time. Still other games require the use of a physical board that is too heavy to permit convenient portable play.

Games involving words, phrases, or sentences on game pieces, cards, boards, or other game elements present the potential disadvantage of limiting play to those game players who readily understand the language that the words, phrases, or sentences are written in. On the other hand, games involving relatively universally understood numeral systems, such as the Arabic numeral system or a simple unary numeral system (e.g. dots on playing die), are readily adoptable by larger numbers of people.

Known board games often incorporate well-known board designs and methods of play. What is needed are new board games having improved game board designs and offering new methods of play that create additional strategic movement and game play considerations for players.

BRIEF SUMMARY OF THE INVENTION

Embodiments of the present invention relate to a method of play for a board game, the method including the steps of:

providing a game board having an obstacle, a space associated with the obstacle located on a first side of the obstacle, an alternate space located on the first side of the obstacle, and a space located on a second side of the obstacle, wherein the obstacle is capable of preventing movement of a first player game piece past the obstacle; activating a first chance device for a first time so that the first chance device indicates a first numerical value; placing the first player game piece on the space associated with the obstacle in response to the first chance device indicating the first numerical value; activating the first chance device for a second time so that the first chance device indicates a second numerical value; comparing the second numerical value indicated by the first chance device to a first numerical value indicated by a second chance device activated by a second player; and removing the first player game piece from the space associated with the obstacle in response to observing the result of the comparison between the second numerical value indicated by the first chance device and the first numerical value indicated by the second chance device.

Embodiments of the present invention also relate to a method of play for a board game including a game board having a plurality of spaces, the method including the steps of: (a) providing a first player game piece having a strength value; (b) providing a first chance device capable of indicating chance values; (c) determining the movement of the first player game piece among the spaces of the game board; and (d) determining that the first player game piece located on a first space has defeated a second player game piece located on a second space adjacent to the first space, wherein the determinations in steps (c) and (d) are each based on both the strength value of the first player game piece and a chance value provided by the first chance device.

Embodiments of the present invention further relate to a board game including a game piece; a die for determining movements of the game piece; a game board having a plurality of spaces upon which the game piece can be moved about in response to rolling the die, the game board further comprising: a starting space upon which the game piece is placed at to begin the board game; a plurality of open spaces upon which the game piece can each freely move during the game; a plurality of closed spaces upon which the game piece cannot freely move during the game; a first obstacle located between a first set of two of the plurality of spaces of the game board, wherein the first obstacle is capable of limiting the movement of the game piece among the first set of two spaces; a second obstacle located between a second set of two of the plurality of spaces of the game board, wherein the second obstacle is capable of limiting the movement of the game piece among the second set of two spaces; and a second obstacle removal space upon which the game piece may move, wherein movement of the game piece onto the second obstacle removal space is capable of removing the second obstacle from the game board and therefore eliminating the second obstacle's capability to limit the movement of the game piece.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention by way of example, and not by way of limitation, and, together with the description, further serve to explain the principles of the invention and to enable a person skilled in the pertinent art to make and use the invention.

DETAILED DESCRIPTION OF THE INVENTION

Figure 1:
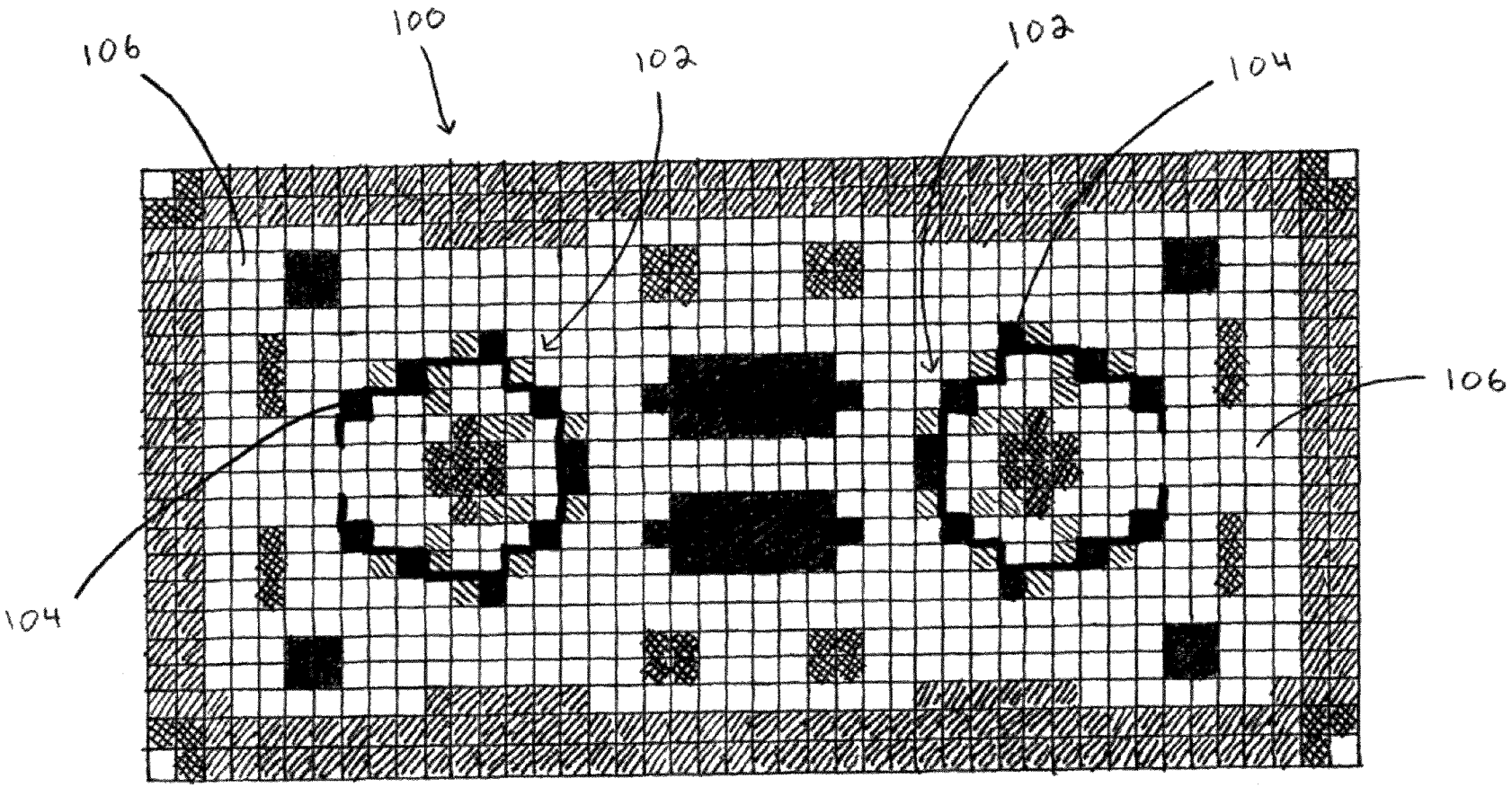
FIGS. 1-4 are illustrations of a game board according to an embodiment of the present invention.

The present invention will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but that every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

FIGS. 1-6 are illustrations of a game board 100 for use with a board game according to an embodiment of the present invention. The game board 100 may serve as a surface upon which one or more game pieces may be placed, removed, and moved according to one or more rules of the board game.

In one embodiment of the present invention, the game board 100 may be a "physical" board 100 formed from one or more materials such as, for example, plastic, wood, metal, or a paper-based material (e.g. paperboard, pasteboard, or cardboard). In an embodiment, the game board 100 may be may be sufficiently small in surface area, thin and/or light such that portability of the game board is increased. Because of its physical nature, players of a board game employing a physical board 100 may move physical game pieces about the physical board 100.

In another embodiment of the present invention, the game board 100 may be a "virtual" board 100 displayed on a display screen. Devices with display screens that may be used in conjunction with the present invention may include, for example, televisions, desktop computers, laptop computers, non-hand-held video game systems, hand-held video game systems, mobile telephones, personal digital assistants, and portable music playing devices. Those of skill in the art will understand, therefore, that aspects of some embodiments of the present invention may be practiced using electronic circuitry, such as solid state circuitry, and/or may be implemented using computer-executable instructions (such as software program modules) executed by programmable computing devices. Thus, players of a board game employing a virtual board 100 may move virtual pieces about the virtual board 100.

As illustrated in FIGS. 1-5, a playing surface of the game board 100 may be divided into a plurality of portions. According to one or more rules of the board game, the ways in which players of the board game may move game pieces about the game board 100 may be affected by rules or characteristics associated with certain portions of the game board 100 surface.

In one embodiment of the present invention, the game board 100 may be divided into nine hundred and sixty eight (968) portions. The portions may be located throughout an equally-spaced rectangular grid measuring forty four (44) portions on one side by twenty two (22) portions on the other side. In other embodiments, greater or fewer total numbers of portions may be used, the portions need not be equally spaced or sized, and the portions need not be laid out in a rectangular formation. Varying the particular arrangement of the portions may create additional strategic movement and game play considerations for players.

The game board 100 surface may be designed with a particular number (or maximum number) of game players in mind. For example, the game board 100 depicted in the embodiment of FIGS. 1-5 may be suitable for use by two game players.

As illustrated in FIG. 1, the game board 100 surface may include two home bases 102, which are defined by the two roughly circular regions depicted at the left-center and right-center regions of the game board 100 of FIG. 1. More specifically, FIG. 1 depicts the home bases 102 as incomplete roughly circular structures each having an opening or discontinuity their perimeter. Each home base 102 may be associated with one of the two game players.

In an embodiment of the present invention, a number of starting spaces 104 may be located within or proximate to each home base 102. Two such starting spaces 104 are depicted in FIG. 1. The starting spaces 104 may be portions of the game board 100 where game players' game pieces may initially be placed at the start of the game. For example, the starting spaces 104 for one player may be located within or proximate to the home base 102 depicted on the left side of the game board 100 in FIG. 1, while the starting spaces 104 for the other player may be located within or proximate to the home base 102 depicted on the right side of the game board 100 in FIG. 1. Thus, by assigning a home base 102 to each game player, separating the home bases 102 across the game board 100 surface, and requiring each player to initially place their game pieces within or proximate to their respective home base 102, the general layout of the game board 100 could be said to resemble that of a football field or a battle field pitting two sides against one another. Such an arrangement creates additional strategic movement and game play considerations for players.

Although FIGS. 1-5 depict game boards 100 including two home bases 102 to enable game play by a maximum of two game players, the present invention is not so limited. For example, those of skill in the art will recognize that additional home bases 102 could be added to the game board 100 playing surface. Furthermore, in an embodiment, two or more players may be able to share one or more home bases 102. Accordingly, the game board 100 could be configured to allow for game play by at least several additional game players. In addition, while the game board 100 depicted in FIGS. 1-5 appears to show a symmetrical surface presenting identical regions on two adjacent sides (i.e. the left and right sides), the present invention is not limited thereto; asymmetrical board surfaces may be employed in alternative embodiments.

As best illustrated in FIG. 1, the playing surface of the game board 100 may include a plurality of open spaces 106. In one embodiment, the open spaces 106 are present in a large portion of the playing surface. Open spaces 106 are generally depicted as white squares in FIG. 1, but do not include the four white squares illustrated at the four corners of the game board 100. In an embodiment of the present invention, game players may freely move their pieces onto and off of the open spaces 106 in accordance with one or more rules of the game.

Figure 2:
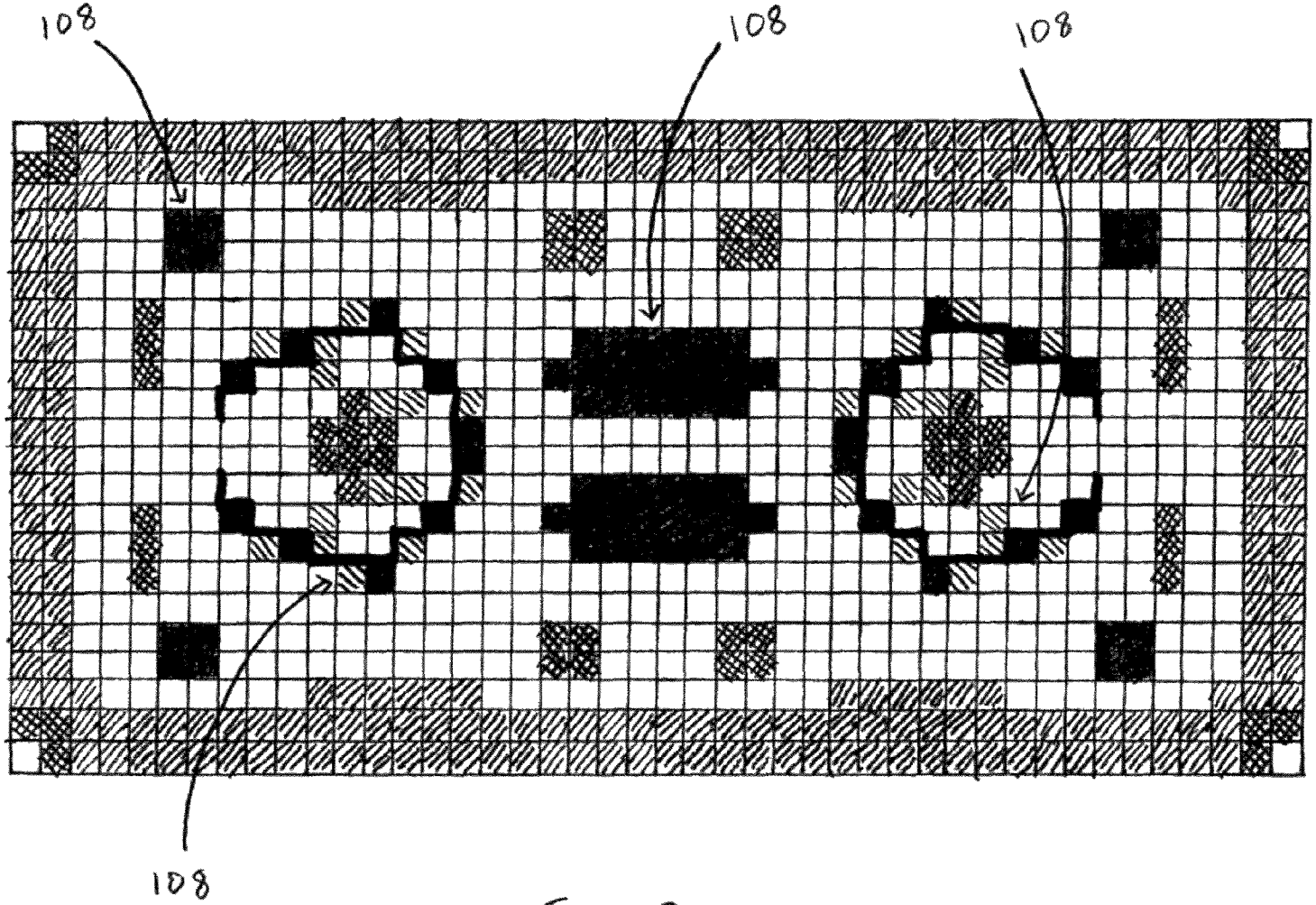

As best illustrated in FIG. 2, the playing surface of the game board 100 may also include a plurality of closed spaces

108. In one embodiment, closed spaces 108 may be concentrated in three areas of the game board 100 surface. First, one or more contiguous closed spaces 108 may be located at or near the center of the game board 100. For example, FIG. 2 depicts two (2) large, separate regions including several contiguous closed spaces 108 (depicted as solid black spaces) near the center of the game board 100. Furthermore, several contiguous closed spaces 108 may be located toward the corners of the game board 100. For example, FIG. 2 depicts four (4) smaller regions each including four (4) contiguous closed spaces 108 (depicted as solid black spaces) located toward the corners of the game board 100 that are surrounded by open spaces 106. Finally, several closed spaces 108 may be located within or proximate to each of the home base 102 regions. For example, FIG. 2 depicts sixteen (16) individual closed spaces 108 (depicted as hatched spaces) within or proximate to each of the home bases 102 on the game board 100.

In an embodiment of the present invention, game players may not move their pieces onto the closed spaces 108 at any time during game play.

Figure 3:
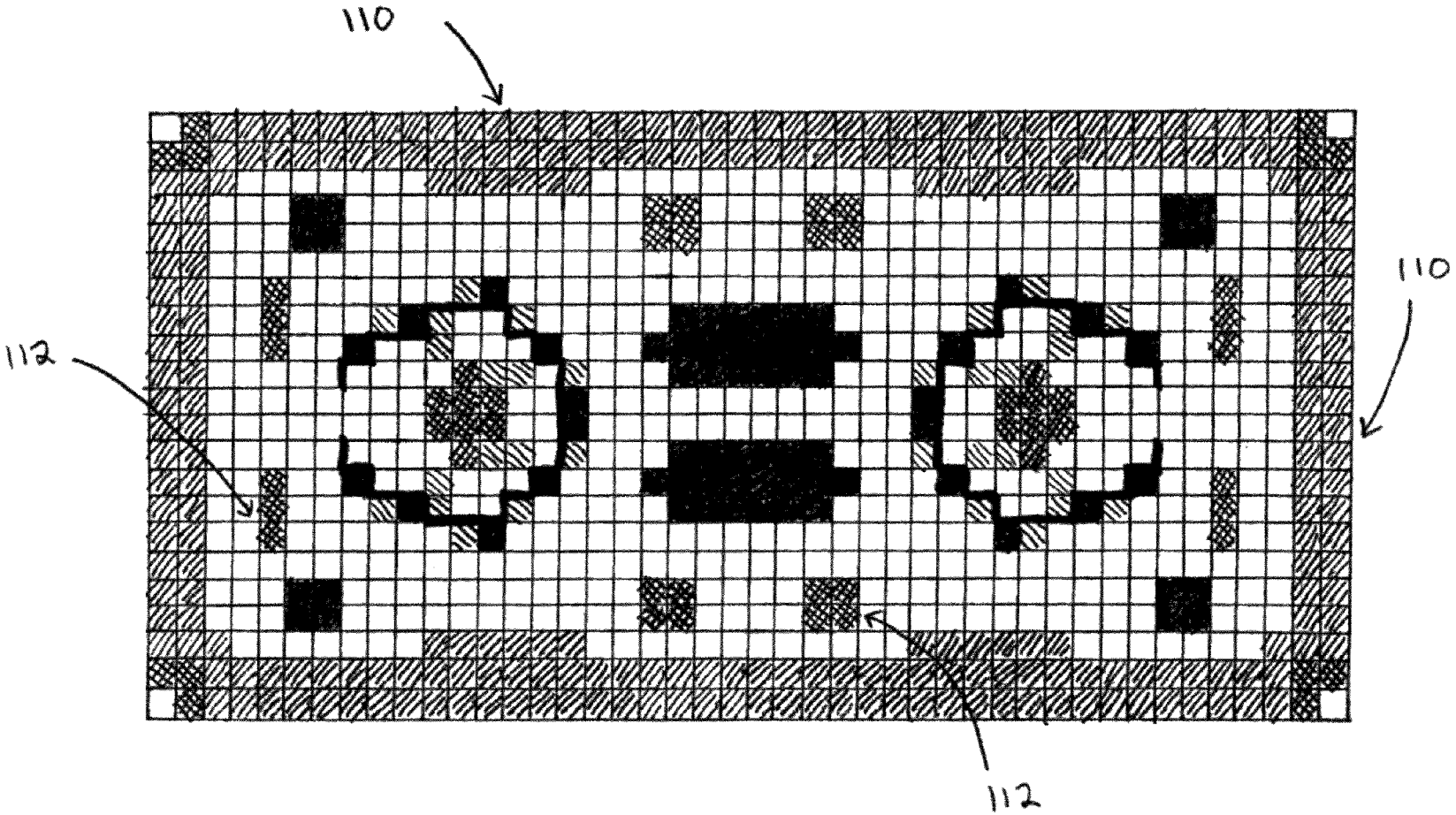

As best illustrated in FIG. 3, the playing surface of the game board 100 may also include a plurality of safe spaces. Safe spaces may include temporary safe spaces 110 and permanent safe spaces 112. In one embodiment, temporary safe spaces 110 may be concentrated about the periphery of the game board 100. Temporary safe spaces 110 are generally depicted as the hatched squares about the periphery of the game board 100 in FIG. 1 (they do not include the hatched squares representing closed spaces 108 within or proximate to the home bases 102, as described above). In an embodiment of the present invention, a game player who moves a game piece onto a temporary safe space 110 on one turn must move that game piece away from temporary safe spaces 110 on the player's next turn.

In an embodiment, the permanent safe spaces 112 may be concentrated at several places on the game board 100. For example, permanent safe spaces 112 are depicted in FIG. 1 as four (4) different groups of four (4) cross-hatched squares, two groups being in the upper-central region of the game board 100 and two groups being in the lower-central region of the game board 100. Permanent safe spaces 112 are also depicted in FIG. 1 as four (4) different groups of three (3) cross-hatched squares, two groups being in the left region of the game board 100 and two groups being in the right region of the game board 100. As explained in further detail below, the groups of cross-hatched squares located within the two home base 102 regions are not indicative of permanent safe spaces 112. In an embodiment of the present invention, a game player who moves a game piece onto a permanent safe space 112 on one turn is not required to move that game piece away from permanent safe spaces 112 on the player's next turn.

Figure 4:
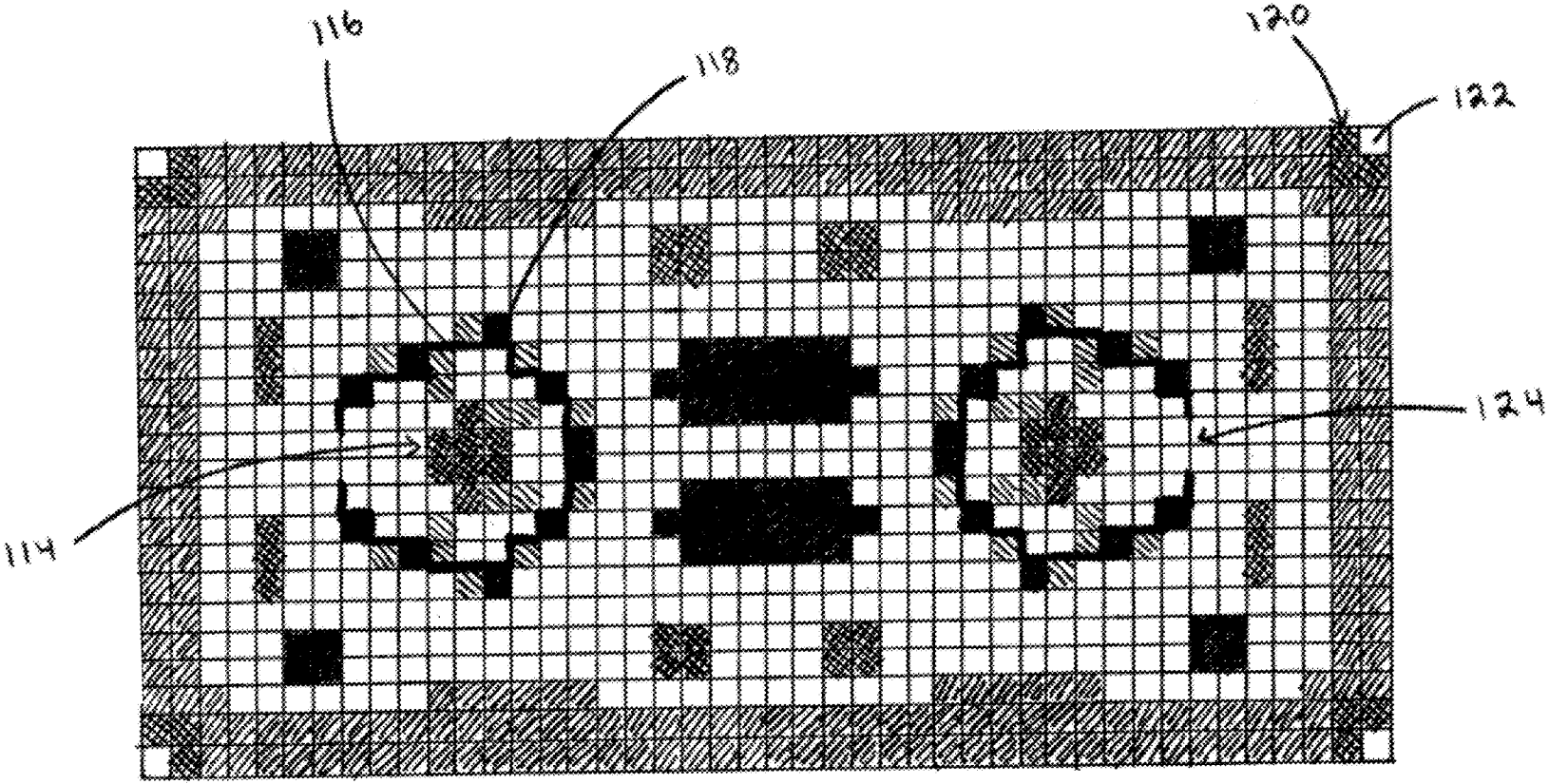

As best illustrated in FIG. 4, the playing surface of the game board 100 may also include bunker spaces 114. In one embodiment, the bunker spaces 114 may be concentrated within the two home base 102 regions. For example, bunker spaces 114 are depicted in FIG. 4 as groups of eight (8) contiguous cross-hatched squares located within the bunker spaces 114 of the game board 100. In an embodiment of the present invention, an objective of the game may be for each player to move their game pieces onto the bunker spaces 114 located within an opposing player's home base 102 region.

The playing surface of the game board 100 may also include one or more obstacles. Obstacles may be located on or between game board 100 spaces. Some obstacles may divide the game board 100 or portions of the game board 100 into separate sides. For example, if a linear obstacle is located between two adjacent spaces, spaces on side of the linear obstacle can be considered to be one side of the obstacle while spaces on the other side of the linear obstacle can be considered to be on the other side of the obstacle.

As illustrated by FIG. 4, the playing surface of the game board 100 may include an obstacle in the form of one or more walls 116, and may further include one or more wall battle spaces 118. In one embodiment, the walls 116 may be present between certain adjacent game board 100 spaces, and may limit the movement of game pieces, in accordance with one or more game rules. For example, the walls 116 are depicted in FIG. 4 as existing in the vicinity of the two home base 102 regions of the game board 100, and abutting several closed spaces 108. The walls 116 are also depicted as abutting several wall battle spaces 118 of the game board 100. The wall battle spaces 118 are shown in FIG. 4 as ten (10) solid black spaces in the vicinity of each of the home base 102 regions. Wall battle spaces 118 may be associated with portions of the walls 116 that they abut. The rules and/or game play characteristics associated with the wall battle spaces 118 will be described in further detail below.

In an embodiment of the present invention, one or more of the starting spaces 104 are the same as one or more of the wall battle spaces 118. In a further embodiment of the present invention, one or more of the starting spaces 104 are the same as one or more of the bunker spaces 114.

As further illustrated by FIG. 4, the playing surface of the game board 100 may also include one or more promotion spaces 120, demolition spaces 122, and demolition zones 124. For example, in FIG. 4, demolition spaces 122 are depicted as the four (4) white spaces at the four (4) corners of the game board 100, and promotion spaces 120 are depicted as groups of three (3) cross-hatched spaces immediately bordering each of the four (4) demolition spaces 122. The rules and/or game play characteristics associated with the promotion spaces 120 and demolition spaces 122 will be described in further detail below. Finally, as indicated in FIG. 4, the demolition zones 124 are the areas on the left side of the left home base 102 and the right side of the right home base 102 where two-space-long discontinuities exist in the walls 116 associated with the home bases 102. The game play characteristics associated with the demolition zones 124 will be described in further detail below.

It should be noted that the precise quantities and arrangements of the open spaces 106, closed spaces 108, temporary safe spaces 110, permanent safe spaces 112, bunker spaces 114, walls 116, wall battle spaces 118, promotion spaces 120, demolition spaces 122, and demolition zones 124 depicted in the figures are exemplary only and should not be understood to be limiting. Those of skill in the art will appreciate that the precise quantities and arrangements of these elements may be modified without departing from the scope of the present invention. However, at least the precise quantities and arrangements of these elements outlined in the exemplary embodiment presented in FIGS. 1-5 have been found to create suitable strategic movement and game play considerations for players.

In an embodiment of the present invention, each game player may move a plurality of pieces about the surface of the game board 100 in accordance with one or more rules of the game and in response to a value presented by a chance device. In one embodiment, the chance device may be one or more die such as, for example, a six-sided die with unary numeral markings. Suitable chance devices may also include, for example, spinning wheels, cards, or other devices capable of indicating a numerical value upon activation.

The use of chance devices such as those described above allows elements of chance to be incorporated into a strategic game which may allow for more diverse and multi-faceted game strategies while also leveling the playing field between beginners and experts to some degree.

Figure 6:
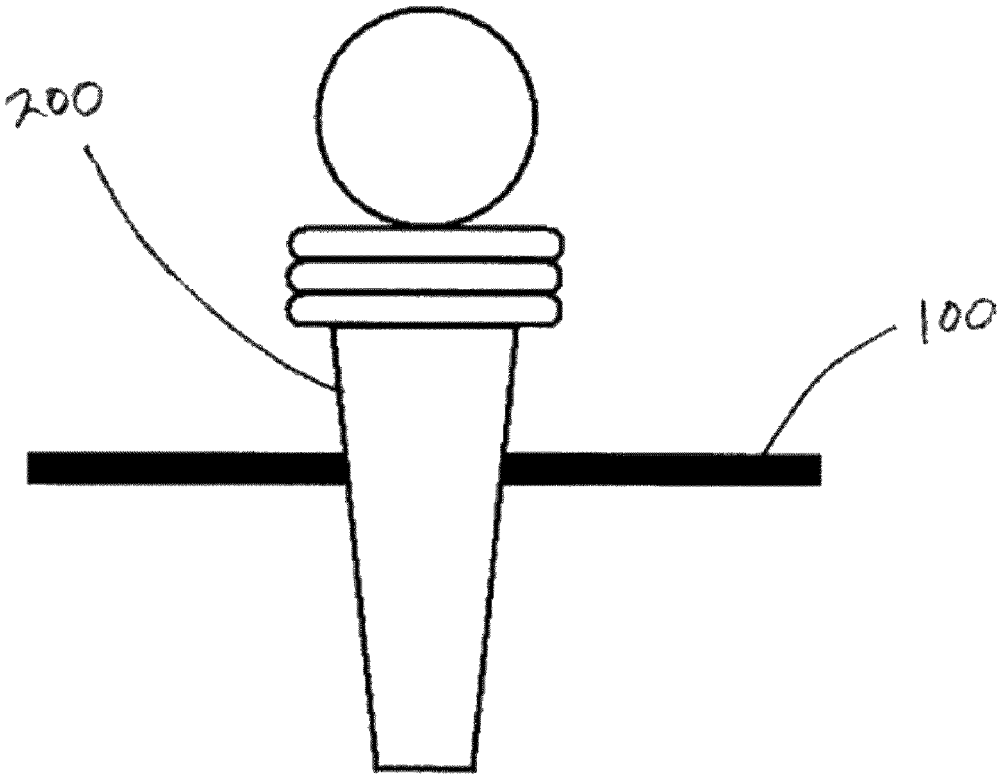
FIG. 6 is a sectional view of a game piece coupled a game board according to an embodiment of the present invention.

Each game player may have a plurality of game pieces at his or her disposal during the game. In one embodiment, each player may start play with nine (9) game pieces. The individual game pieces may be grouped into several different classes. A "strength" may be associated with each class. For example, in one embodiment, each game player may begin game play with: (a) five "guard" pieces (or "guards") each having a strength of zero, (b) three "officer" pieces (or "officers") each having a strength of two, and (c) one "general" piece (or "general) having a strength of three. In an embodiment, game pieces having different strengths will be visually discernable from one another. For example, as illustrated in FIG. 6, when a physical game board 100 and physical game pieces 200 are used, the physical game pieces 200 may have several tiers or layers at indicative of their relative strengths. Accordingly, the game piece 200 depicted in FIG. 6 has three tiers and thus may be visually identifiable as a general piece having a strength of three. Alternatively or additionally, game pieces may include different shapes, sizes, colors, facial features, uniforms, or other distinguishing characteristics indicative of their relative strengths. The use of game pieces with varying strengths may create additional strategic movement and game play considerations for players.

Additional reserve pieces may be allocated to each player but may not be available for use at the beginning of each game, as explained in further detail below. The game piece classification system, the precise number of each class of game pieces, or the overall number of game pieces employed may be modified without departing from the scope of the present invention.

In one embodiment of the present invention involving a physical game board 100, a game piece 200 may include a projection projecting from the lower portion of the game piece 200. In addition, the game board 100 may include a plurality of perforations in its surface. Thus, as illustrated in FIG. 6, the game piece 200 may be coupled to the game board 100 by inserting the projection into any one of the plurality of perforations. In an embodiment, secure yet readily removable coupling may be achieved by friction fitting the projection of the game piece into any appropriately sized perforation of the game board 100. For example, a player may insert the projection into a perforation while pressing down slightly with their hand. Thus, the board game may include a game board 100 with a plurality of projections and a plurality of game pieces 200 that may be inserted and removed from the projections throughout the course of the game. In an alternate embodiment, the game board 100 may have a plurality of projections while the game pieces 200 may have cavities, for example, on their lower portions.

Such arrangements may enhance the portability of the game by allowing players to move the game board 100 without scattering the game pieces. Thus, because of the secure coupling structures, game play could be paused and resumed again at a later time and at a different location.

Game play according to the present invention may proceed according to a set of one or more predetermined rules. The following description outlines an exemplary game play method for a two-player game according to an exemplary set of rules that will illustrate the features of the present invention.

In one embodiment of the present invention, an object of the game is for each player to attempt to advance their game pieces onto their opponent's bunker spaces 114 by moving and battling across the game board 100 using a chance device, such as a die. The players compete to get as many of their game pieces into their opponent's bunker spaces 114 as they can until either player cannot make any more moves, or until one player surrenders. In an embodiment, the player who has advanced the most game pieces onto their opponent's bunker spaces 114 at the end of the game is the winner. The total number of pieces advanced to an opponents bunker spaces 114 may determine the strength or quality of the win. An another embodiment, the number of the winning player's game pieces that are still able to move at the end of the game may additionally or alternatively determine the strength or quality of the win.

Figure 5:
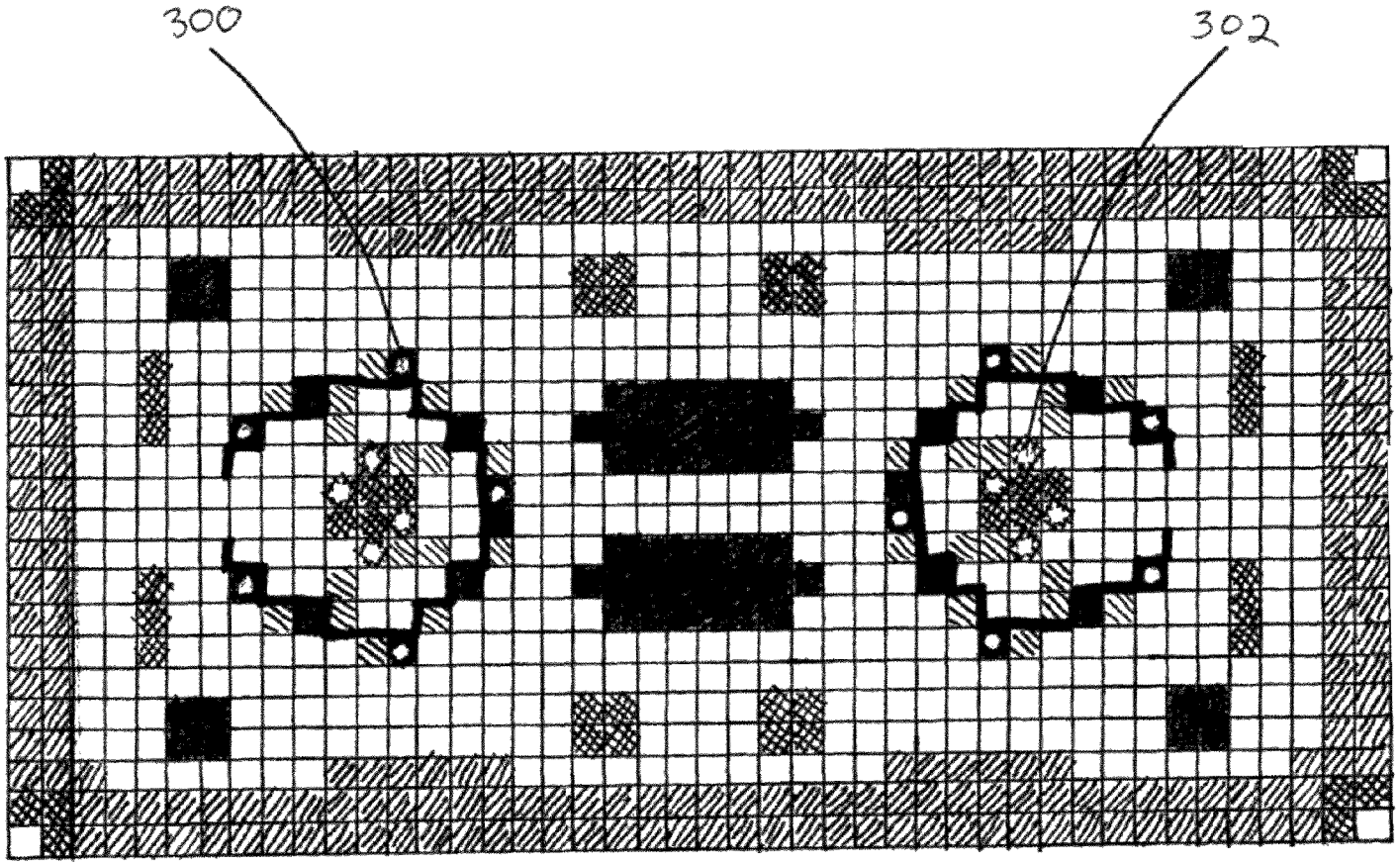
FIG. 5 is an illustration of several game pieces arranged upon a game board according to an embodiment of the present invention.

Prior to beginning the game, each player may place their game pieces in their starting positions. In one embodiment, each player may start play with nine game pieces—five guards, three officers, and one general, as described in further detail above. As further described above, the starting spaces 104 may be portions of the game board 100 where game players' game pieces may initially be placed at the start of the game. For example, FIG. 5 shows each player's nine game pieces, depicted as white dots, arranged on nine starting spaces 104. Note that, in the depicted embodiment, each starting space 104 is also either a bunker space 114 or a wall battle space 118. FIG. 5 indicates one of the wall battle space 118 starting spaces 104 at 300 and indicates one of the bunker space 114 starting spaces 104 at 302. In other embodiments, the starting spaces 104 may be located on other types of spaces, including open spaces 106. In an embodiment, the game pieces may not start directly on one of the game board 100 spaces but may start at positions between spaces, such as on a portion of a wall 116.

In one embodiment of the present invention, the guard pieces are positioned on wall battle space 118 starting spaces 104 while the officer and general pieces are positioned on bunker space 114 starting spaces 104.

Game play begins with one player utilizing a chance device by, for example, rolling a six-sided playing die. In an embodiment, each player may roll a die with the player achieving the higher roll number winning the right to take the first turn in the game.

On a player's turn, the player may roll a die once and may move their game pieces a corresponding number of spaces in any direction on the game board 100. In one embodiment, players may move their game pieces forward, backward, sideways, and diagonally from one square to the next as long as the squares are adjacent. In an embodiment, a player may move either one game piece a number of spaces equal to the number indicated by the die roll or split the total number of spaces to be moved among more than one of their game pieces. For example, if a player rolls a six on their die, the player may move one game piece six spaces, move two game pieces three spaces each, move six game pieces one space each, or any other possible combination of pieces and movements. Players need not utilize the entire value of their role if they so choose. Players may move their own pieces freely in and out of their home base 102 region as desired, and may freely cross walls 116 on their own portion of the board at any time.

In an embodiment, players may not move their pieces by "jumping" other game pieces, and may not move their pieces such that a particular game piece traverses the same game board 100 space multiple times on the same turn.

In one embodiment of the present invention, a player may have the option of executing a "roll call" movement. Specifically, when a player's turn arrives, that player may declare a "roll call," point to one of their officer or general pieces, and roll their die. The number indicated by the die roll may then be multiplied by a "strength" associated with the particular game piece (as described above) to determine the number of spaces that the player is then entitled to move. For example, in an embodiment where an officer piece is assigned a strength of two, if a particular officer piece is "roll called" and a three is rolled on the die, the player is entitled to move that office piece six spaces (i.e. 2×3=6). A "roll call" must be declared before the player rolls once it is his or her turn, and only the particular game piece identified prior to the roll is allowed to move. In other words, the total number of spaces to be moved cannot be split among multiple game pieces, as described above. In an embodiment where a guard piece is assigned a strength of zero, guard pieces cannot be "roll called." Players need not utilize the entire value of their "roll call" role if they so choose (e.g. if you are entitled to move six spaces with the roll-called game piece, you may chose to only move 5 spaces). In embodiments where game pieces having different strengths are visually discernable from one another, this will aid in player's judgments regarding the strength of the various game pieces, both before or during battles.

A player's movement turn may end when the player clearly utilizes all of movements dictated by the die or when the player otherwise declares that they have finished all intended movements. At the end of a movement turn, if opposing players' pieces are located on adjacent spaces, the player whose movement turn has just ended may announce that the adjacent pieces will engage in a battle.

In one embodiment of the present invention, the battle involve a dice roll off with each player rolling a die simultaneously with the other player's die rolling. Generally, the player who rolls a higher number wins the battle and the loser's game piece is removed from the game board 100. In an embodiment, the game board 100 additionally includes a region outside of the primary game play spaces where inactive or eliminated game pieces may be placed.

The determination of which player wins a particular battle may further involve an assessment of the relative strengths associated with the battling game pieces. In one embodiment, pieces engaged in battle may add their strength value (as described above) to the value indicated by their die roll, with the winner of the battle being the player with the higher modified point total. For example, if one player battling with a guard with a strength of zero rolls a five and the other player battling with a general with a strength of three rolls a three, the player battling with the general will win the battle because the value of that player's roll (three) plus the general's strength (three) exceeds the value of the other players roll (five) plus the guard's strength (zero) (i.e. 6>5).

Regardless of whether the pieces engaged in battle rely on strength points or not (e.g. regardless of whether officers or generals are involved in the battle), if the outcome of a battle is that the point totals of each player are equal, both players must roll again until a winner can be determined. In other words, in an embodiment, player's may not tie in a battle. In an alternate embodiment, if player's tie in battle, the battle is a draw and neither player's piece is eliminated. As indicated above, a battle loser's game piece is removed from the game board 100.

When all battles end after one player's movement turn, the other player's movement turn begins. Players may continue to take turns rolling and moving toward their opponent's bunker spaces, battling each other along the way.

Accordingly, in an embodiment of the present invention, a player's turn may proceed as follows:

(1) Player 1's turn begins.
(2) Player 1 may execute a "roll call" movement if they so wish.
(3) Player 1 may roll their die and move their piece(s).
(4) Player 1 and Player 2 may each roll a die to determine the outcomes of any battles.
(5) Player 1's turn ends.

In one embodiment of the present invention, players moving their pieces about the game board 100 may encounter one or more different types of spaces with different characteristics.

The game board 100 may contain one or more closed spaces 108. As described above with reference to FIG. 2, in an embodiment, game players may not move their pieces onto the closed spaces 108 at any time during game play. The presence of closed spaces 108 creates additional strategic movement and game play considerations for players.

The game board 100 may also contain one or more temporary safe spaces 110. As described above with reference to FIG. 3, in an embodiment, a game player who moves a game piece onto a temporary safe space 110 on one turn must move that game piece away from temporary safe spaces 110 on the player's next turn. If the player is unable to move their game piece out on their next turn, then that game piece is eliminated from the game. This may occur, for example, if a player moves a game piece moves onto a temporary safe space 110 on one turn that is surrounded only by other temporary safe spaces 110, and then rolls a one on a subsequent turn; in this case, moving one space will not allow the player's piece to escape temporary safe spaces 110.

The game board 100 may further contain one or more permanent safe spaces 112. As described above with reference to FIG. 3, in an embodiment, in contrast with the rules regarding temporary safe spaces 110, a game player who moves a game piece onto a permanent safe space 112 on one turn is not required to move that game piece away from permanent safe spaces 112 on the player's next turn. Accordingly, players may keep their game pieces on permanent safe spaces 112 as long as they wish.

The safe spaces are unique in that, in one embodiment, game pieces located on temporary safe spaces 110 or permanent safe spaces 112 may not be engaged in battle, even when an opponent's piece is located adjacent to them. Thus, the presence of temporary safe spaces 110 and permanent safe spaces 112 creates additional strategic movement and game play considerations for players.

As described above with reference to FIG. 4, the game board 100 may also contain one or more promotion spaces 120. A player may move one or more of their game pieces toward a promotion space 120 in an effort to increase the strength of their game pieces. For example, in an embodiment, if a guard having a strength of zero points is moved to a promotion space, the guard may be upgraded to an officer having a strength of two points. If an officer having a strength of two points is moved to a promotion space, the officer may be upgraded to a general having a strength of three points. If a general having a strength of three points is moved to a promotion space, the general may be upgraded to a 4-star general having a strength of four points.

In one embodiment of the present invention employing a physical game board 100 and physical game pieces, when a game piece is upgraded, the original game piece may be removed and replaced with a substitute game piece having a higher strength value. Accordingly, the game may be provided with sufficient extra game pieces to accommodate all possible upgrades during game play. As explained above, in some embodiments, game pieces having different strengths will be visually discernable from one another. Thus, after a game piece has been upgraded, the upgrade may be visually discernable to both players.

In an embodiment, no single game piece may be upgraded more than once in a game. For example, if a guard is upgraded to an officer, that same officer cannot later be upgraded to a general. Furthermore, in an embodiment, after landing a game piece on a promotion space 120 and upgrading the piece to the next strength level, the player must move that game piece away from promotion spaces 120 on the player's next turn. If the player fails to do so, the upgraded game piece may be eliminated from the game and removed from the game board 100. The presence of promotion spaces 120 creates additional strategic movement and game play considerations for players.

The game board 100 may also contain one or more obstacles, such as wall 116 segments. As described above with reference to FIG. 4, in one embodiment, obstacles such as walls 116 may be present between certain adjacent game board 100 spaces, and may limit the movement of game pieces. In one embodiment, while walls 116 associated with one player's home base 102 may prevent movement of the other player through the wall 116, a player may freely move through a wall 116 associated with his or her own home base 102.

The game board may further contain one or more demolition spaces 122 and demolition zones 124, as described above with reference to FIG. 4. In one embodiment, demolition zones 124 are areas in or around the home bases 102 where discontinuities exist in the walls 116 associated with the home bases 102. For example, as shown in FIG. 4, demolition zones 124 may exist on the left side of a left home base 102 and the right side of a right home base 102, where two-space-long discontinuities exist in the walls 116 associated with the home bases 102.

In an embodiment of the present invention, at the beginning of the game, each player may place an obstacle, such as a gate piece, in the demolition zone 124 corresponding to their home base 102. During game play, a player looking to advance one of their pieces into an opponent's home base 102 towards their opponent's bunker spaces 114 through the demolition zone 124 would be prevented from doing so by the obstacle. In other words, an obstacle such as a gate piece may functionally act as a wall 116.

However, players may take advantage of one or more obstacle removal spaces, such as demolition spaces 122, to demolish or remove their opponent's gate (i.e. remove the obstacle). Specifically, if a player moves one of their pieces onto an obstacle removal space, their opponent's corresponding obstacle may be bypassed. For example, if a player moves one of their pieces onto a demolition space 122, their opponent's gate piece is eliminated and removed from the board. During subsequent game play, a player looking to advance on of their pieces into an opponent's home base 102 towards their opponent's bunker spaces 114 through the demolition zone 124 would be able to do so freely because the gate piece has been removed. Thus, the presence of the obstacles such as the walls 116 and gate pieces, the obstacle removal spaces such as the demolition spaces 122, and the demolition zones 124 create additional strategic movement and game play considerations for players.

In one embodiment of the present invention, a player may have the option of executing a "wall battle" movement (hereinafter also referred to as "battling the wall"). Battling the wall is another way that one player may bypass an obstacle in an attempt to advance one of their pieces into an opponents home base 102 towards their opponents bunker spaces 114.

Battling the wall may be achieved as follows, according to an embodiment. First, during his or her turn, a player must move one of his or her pieces onto a wall battle space 118, as described above. As also described above, once a player's movement turn ends, battles may be declared between adjacent game pieces. Similarly, when a player's movement turn ends with a game piece on an opponent's wall battle space 118, that player may battle the wall.

The next step in the wall battle involves both players rolling dice simultaneously. The player attacking the wall 116 rolls a die to determine a value for his or her attacker while the player defending their wall 116 rolls a die to determine a value for his or her wall 116. If the attacking player rolls a higher number, the wall 116 has been defeated. If the defending player rolls a higher number, the attacker has been repelled from the wall 116. If both players roll the same number, both players must roll again until a winner is determined. In an embodiment, the relative strength value of a game piece (e.g. 2 points for an officer) is not factored into determining the outcome of a wall battle.

In one embodiment, if the attacking player defeats the wall, the attacker may move their game piece through the opponent's wall 116 and advance a number of spaces equal to the value that the defending player rolled with their die. For example, if the attacking player rolled a three and the defending player rolled a one, the attacking player could move their game piece one space inside the wall.

Because an objective of the game may be for each player to attempt to advance their game pieces onto their opponent's bunker spaces 114, once inside the opponent's wall 116, the attacking player may desire to move their pieces onto the bunker spaces 114. In an embodiment of the invention, each bunker space 114 is located at least three spaces away from a wall 116. Accordingly, if the player defending the wall rolls a three or higher but still loses the wall battle, the attacking player may be able to advance their game piece all the way to a bunker space 114 upon defeating the wall 116. If the player defending the wall 116 rolls a one or two while losing, the attacking player may require one or more additional movement turns to reach their opponent's bunker spaces 114.

Players may chose to position one or more of their game pieces within their own home base 102 area such that an opponent defeating the wall 116 or otherwise entering the home base 102 area may be forced to battle their opponent's pieces en route to the bunker spaces 114. If an attacking player lands on a wall battle space 118 while one of their opponent's game pieces is directly on the other side of the wall 116 adjacent to the wall battle space 118, the attacking player must defeat both the wall 116 and the defending player's piece, one after the other, before advance in inward in the event that the wall 116 is defeated. In an embodiment, the attacking player must first battle the defending player's piece, then battle the wall.

On the other hand, if the wall 116 defeats the attacking player, the attacking player's piece is repelled from the wall 116. Specifically, upon defeating the attacking player, the defending player may move the attacking piece back away from the wall 116 in any direction on the board a number of spaces equal to the value rolled by the defending player during the wall battle. In one embodiment, the defending player may be able to repel the attacking player's game piece onto a temporary safe space 110. Accordingly, that attacking player's game piece may risk elimination if it is not removed from temporary same spaces 110 on that player's next movement turn.

In an embodiment, if a player needs to move additional spaces to advance towards a bunker space 114 once already inside an opponent's home base 102, they cannot split their roll among multiple game pieces to achieve such movement. Thus, any unused movement spaces may be forfeited.

Accordingly, the presence of the wall battle spaces 118 and the "wall battle" movement create additional strategic movement and game play considerations for players.

Accordingly, in an embodiment of the present invention, a player's turn may proceed as follows:

(1) Player 1's turn begins.

(2) Player 1 may execute a "roll call" movement if they so wish.

(3) Player 1 may roll their die and move their piece(s).

(4) Player 1 and Player 2 may each roll a die to determine the outcomes of any regular battles and/or wall battles.

(5) Player 1's turn ends.

Upon moving a game piece onto an opponent's bunker space, a player scores one point. In one embodiment, after the point is scored, the game piece may be removed from the game board. The player having the most points may be declared the winner if at any point either opponent is unable to advance or move any game pieces in any direction on the game board. The player having the most points may also be declared the winner if that player's opponent surrenders.

According to some embodiments of the present invention, one or more of the improved game board designs and new game play methods disclosed may allow for total game play time that is considerably less that that associated with other prior art board games. In an embodiment, average game play time may be 30 minutes or less. In our fast-paced modern society, many people are unwilling to devote hours on end to playing a board game.

Embodiments of the present invention may include a game box for storing a physical game board 100 and various game pieces of a board game. In an embodiment, the physical game board 100 may be small enough relative to its game boxes so that the game board 100 need not be folded or disassembled in order to be stored in the box. Thus, game pieces positioned on the board would not need to be removed if a game is paused and stored inside the box for resumption of play at a later time.

In one embodiment, the game board 100 and game pieces do include words, phrases, or sentences on them. Accordingly, use of the game board 100 and game pieces is not limited to those game players who readily understand the language that the words, phrases, or sentences are written in.

The present invention has been described above by way of exemplary embodiments. Accordingly, the present invention should not be limited by any of the above-described exemplary embodiments, but should be defined only in accordance with the following claims and their equivalences.

What is claimed is:

1. A board game, comprising:

a game piece;

a die for determining movements of the game piece;

a game board having a plurality of spaces upon which the game piece can be moved about in response to rolling the die, the plurality of spaces configured to receive the game piece, the plurality of spaces including:

a first plurality of spaces on a first side of the game board, each space of the first plurality of spaces having a first indicia pattern, a second plurality of spaces, each space of the second plurality of spaces having a second indicia pattern different from the first indicia pattern, the second plurality of spaces being adjacent to and surrounding the first plurality of spaces, a third plurality of spaces being spaced apart from each other, each space of the third plurality of spaces having a third indicia pattern different from the first and second indicia patterns, the third plurality of spaces being adjacent to and surrounding the second plurality of spaces, a fourth plurality of spaces on a second side of the game board opposite the first side, each space of the first plurality of spaces having the first indicia pattern, a fifth plurality of spaces, each space of the fifth plurality of spaces having the second indicia pattern, the fifth plurality of spaces being adjacent to and surrounding the fourth plurality of spaces, and a sixth plurality of spaces being spaced apart from each other, each space of the sixth plurality of spaces having the third indicia pattern, the sixth plurality of spaces being adjacent to and surrounding the fifth plurality of spaces.

2. The board game of claim 1, wherein the first, second, and third pluralities of spaces together define a roughly circular shape, and wherein the fourth, fifth, and sixth pluralities of spaces together define a roughly circular shape.

3. The board game of claim 1, wherein the game board further comprises a first plurality of areas each having a fourth indicia pattern and a second plurality of areas each having the fourth indicia pattern, each of the first plurality of areas having the fourth indicia pattern being spaced between a pair of spaces of the third plurality of spaces, each of the second plurality of areas having the fourth indicia pattern being spaced between a pair of spaces of the sixth plurality of spaces.

4. The board game of claim 3, wherein each of the first and second pluralities of areas are linear.

5. The board game of claim 1 further comprising a seventh plurality of spaces each having a fourth indicia pattern different from the first, second, and third indicia patterns, the seventh plurality of spaces forming an outer periphery of the game board.

6. The board game of claim 1, wherein the first, second, and third pluralities of spaces each form a geometric shape, and the geometric shape formed by the first plurality of spaces differs from the geometric shapes formed by the second and third pluralities of spaces.

7. The board game of claim 1 further comprising a seventh plurality of spaces each having a fourth indicia pattern different from the first, second, and third indicia patterns, the seventh plurality of spaces disposed between the first plurality of spaces and the fourth plurality of spaces.

8. A method of play for a board game, comprising:

displaying a virtual game board on a display screen, the virtual game board on the display screen having:

a first plurality of spaces on a first side of the virtual game board, each space of the first plurality of spaces having a first indicia pattern, a second plurality of spaces, each space of the second plurality of spaces having a second indicia pattern different from the first indicia pattern, the second plurality of spaces being adjacent to and surrounding the first plurality of spaces, a third plurality of spaces being spaced apart from each other, each space of the third plurality of spaces having a third indicia pattern different from the first and second indicia patterns, the third plurality: of spaces being adjacent to and surrounding the second plurality of spaces, and a fourth plurality of spaces surrounding the first, second, and third pluralities of spaces;

displaying a game piece on a first space of the third plurality of spaces on the virtual game board;

activating a first chance device by a first player so that the first chance device indicates a numerical value;

activating a second chance device by a second player so that the second chance device indicates a numerical value;

moving the game piece a number of spaces from the first space to a second space of the first or second pluralities of spaces on the virtual game board when the numerical value indicated on the first chance device is greater than the numerical value indicated on the second chance device; and moving the game piece the number of spaces from the first space to a third space of the fourth plurality of spaces on the virtual game board when the numerical value indicated on the second chance device is greater than the numerical value indicated on the first chance device, wherein the number of spaces away from the first space is equal to the numerical value indicated on the second chance device.

9. A method of play for a board game, comprising:

displaying a virtual game board on a display screen, the virtual game board on the display screen having a plurality of spaces, each space having an indicia pattern;

displaying a plurality of game pieces on the virtual game board, each game piece being displayed on a respective first space of the plurality of spaces, each game piece having a strength value;

designating one game piece from the plurality of game pieces to move before activating a first chance device;

activating the first chance device so that the first chance device indicates a numerical value; and moving only the designated game piece from the respective first space of the designated game piece to a second space of the plurality of spaces, the second space being a number of spaces away from the respective first space, the number of spaces away from the respective first space of the designated game piece being based on a combination of the numerical value and the strength value of the designated game piece.

10. The method of play for a board game of claim 9, wherein the combination is a product of the numerical value and the strength value of the designated game piece.

11. The method of play for a board game of claim 9, wherein at least two of the plurality of game pieces have different strength values.

12. A method of play for a board game, comprising:

displaying a virtual game board on a display screen, the virtual game board on the display screen having:

a first plurality of spaces on a first side of the virtual game board, each space of the first plurality of spaces having a first indicia pattern, a second plurality of spaces, each space of the second plurality of spaces having a second indicia pattern different from the first indicia pattern, the second plurality of spaces surrounding the first plurality of spaces, a third plurality of spaces, each space of the third plurality of spaces having a third indicia pattern different from the first and second indicia patterns, the third plurality of spaces surrounding the second plurality of spaces, and a fourth plurality of spaces surrounding the first, second, and third pluralities of spaces;

displaying a plurality of first and second player game pieces on the virtual game board; each game piece being displayed on a respective first space of the first, second, third, or fourth pluralities of spaces on the virtual game board, each game piece having a strength value;

activating a first chance device by a first player for a first time so that the first chance device indicates a first numerical value;

moving a first player game piece to a second space of the first, second, third, or fourth pluralities of spaces, the second space being a first number of spaces away from the respective first space of the first player game piece, the first number of spaces being based on the first numerical value;

when the second space is adjacent a third space of the first, second, third, or fourth pluralities of spaces on the virtual game board on which a second player game piece is displayed, activating the first chance device by the first player for a second time so that the first chance device indicates a second numerical value, activating a second chance device by the second player for a first time so that the second chance device indicates a first numerical value, removing the first player game piece from the virtual game board when a first sum of the second numerical value indicated by the first chance device and the strength value of the first player game piece is less than a second sum of the first numerical value indicated by the second chance device and a strength value of the second player game piece, and removing the second player game piece from the virtual game board when the first sum is greater than the second sum; and when the second space is a space of the third plurality of spaces associated with an obstacle, activating the first chance device by the first player for a third time so that the first chance device indicates a third numerical value, activating the second chance device by the second player for a second time so that the second chance device indicates a second numerical value, moving the first player game piece a second number of spaces from the second space to a fourth space of the first or second pluralities of spaces on the virtual game board when the third numerical value indicated on the first chance device is greater than the second numerical value indicated on the second chance device, and moving the first player game piece the second number of spaces from the second space to a fifth space of the fourth plurality of spaces on the virtual game board when the second numerical value indicated on the second chance device is greater than the third numerical value indicated on the first chance device, wherein the second number of spaces from the second space is equal to the second numerical value indicated on the second chance device.

13. The method of play for a board game of claim 12, wherein moving the first player game piece the first number of spaces to the second space on the virtual game board comprises designating one game piece from the plurality of first player game pieces to move before activating the first chance device by the first player for the first time so that the first chance device indicates the first numerical value, and wherein the first number of spaces is a product of the first numerical value and the strength value of the designated first player game piece.

14. The method of play for a board game of claim 12, wherein when the second space is a space of the fourth plurality of spaces that is associated with a second obstacle, the second obstacle is removed from the virtual game board, the second obstacle being between a pair of adjacent spaces of the second and fourth pluralities of spaces on the virtual game board, the second obstacle preventing the first player game piece from moving between the pair of adjacent spaces of the second and fourth pluralities of spaces on the virtual game board.

15. The method of play for a board game of claim 12, wherein the virtual game board on the display screen further comprises:

a fifth plurality of spaces on a second side of the game board opposite the first side, each space of the first plurality of spaces having the first indicia pattern, a sixth plurality of spaces, each space of the fifth plurality of spaces having the second indicia pattern, the sixth plurality of spaces surrounding the fifth plurality of spaces, and a seventh plurality of spaces, each space of the sixth plurality of spaces having the third indicia pattern, the seventh plurality of spaces surrounding the sixth plurality of spaces, wherein the fourth plurality of spaces surrounds the fifth, sixth, and seventh plurality of spaces; and wherein the method further comprises determining a winner of the board game by comparing a number of first player game pieces on the first plurality of spaces with a number of second player game pieces on the fifth plurality of spaces, the winner being the player with the most game pieces in the respective first and fifth pluralities of spaces.

* * * * *